US007381319B2

(12) United States Patent
Lack et al.

(10) Patent No.: US 7,381,319 B2
(45) Date of Patent: Jun. 3, 2008

(54) MULTI-AMINE NEUTRALIZER BLENDS

(75) Inventors: Joel E. Lack, Sugar Land, TX (US); George G. Duggan, Katy, TX (US); Michael J. Zetlmeisl, Katy, TX (US)

(73) Assignee: Baker Hughes Incorporated, Houston, TX (US)

( * ) Notice: Subject to any disclaimer, the term of this patent is extended or adjusted under 35 U.S.C. 154(b) by 669 days.

(21) Appl. No.: 10/930,876

(22) Filed: Aug. 31, 2004

(65) Prior Publication Data

US 2005/0051462 A1 Mar. 10, 2005

Related U.S. Application Data

(60) Provisional application No. 60/500,541, filed on Sep. 5, 2003.

(51) Int. Cl.
*C10G 7/10* (2006.01)
*C23F 11/14* (2006.01)

(52) U.S. Cl. ..... 208/47; 252/390; 508/545; 508/561; 508/562; 585/950

(58) Field of Classification Search ..... 252/390; 208/47
See application file for complete search history.

(56) References Cited

U.S. PATENT DOCUMENTS 2,889,276 A 6/1959 Barrett et al.
3,447,891 A 6/1969 Crawford
3,458,453 A 7/1969 Kautsky
4,062,764 A 12/1977 White et al.
4,430,196 A 2/1984 Niu
4,490,275 A 12/1984 Niu
4,806,229 A 2/1989 Ferguson et al.
4,992,210 A * 2/1991 Naeger et al. ..... 252/389.62
5,283,006 A 2/1994 Lehrer et al.
5,714,664 A 2/1998 Fearnside et al.
5,764,717 A * 6/1998 Rootham ..... 376/316
5,939,362 A * 8/1999 Johnson et al. ..... 507/118
5,965,785 A 10/1999 Braden et al.
5,976,359 A 11/1999 Parker
6,350,395 B1 * 2/2002 Kuemin ..... 252/401
6,982,062 B2 * 1/2006 DeCordt et al. ..... 422/16

* cited by examiner

*Primary Examiner*—Ellen M. McAvoy
(74) *Attorney, Agent, or Firm*—Madan, Mossman & Sriram, PC

(57) ABSTRACT

Amine and amine blend compositions neutralize acid environments in distillation overheads of hydrocarbon processing facilities. The neutralizers are composed of certain combinations of amines which are relatively stronger bases and more resistant to hydrochloride salt formation. The amines, when blended together, provide greater neutralization of condensed water present without increased potential for corrosive hydrochloride salt formation.

14 Claims, No Drawings

MULTI-AMINE NEUTRALIZER BLENDS

CROSS-REFERENCE TO RELATED APPLICATION

This application claims the benefit of U.S. provisional application No. 60/500,541 filed Sep. 5, 2003.

FIELD OF THE INVENTION

The invention relates to compositions to be added to systems of condensing hydrocarbons and water to inhibit the corrosion of metals therein, and most particularly relates, in one non-limiting embodiment, to methods of using amine blends in condensing hydrocarbons and water to inhibit the corrosion of metals therein.

BACKGROUND OF THE INVENTION

Hydrocarbon feedstocks such as petroleum crudes, gas oil, etc. are subjected to various processes in order to isolate and separate different fractions of the feedstock. In refinery processes, the feedstock is distilled so as to provide the various valuable fractions, e.g. light hydrocarbons, gasoline, naphtha, kerosene, gas oil, etc. The lower boiling fractions are recovered as an overhead fraction from the distillation column. The intermediate components are recovered as side cuts from the distillation column. The fractions are cooled, condensed, and sent to collecting equipment. No matter what type of petroleum feedstock is used as the charge, the distillation equipment is subjected to the corrosive activity of acids such as $H_2S$, HCl, organic acids, and $H_2CO_3$. The problem of corrosion caused by these acid gases as water condenses in the overhead condensing systems of distillation columns is well known. The consequent presence of acidic water leads to the undesirable corrosion of metallic equipment, often rapidly.

The general mechanism of this corrosion is an oxidation of metal atoms by aqueous hydrogen ions:

$$M^0 + X\,H^+_{(aq)} \rightarrow M^{X+}_{(aq)} + X/2H_2\uparrow \quad (I)$$

The rate of corrosion is directly related to the concentration of aqueous hydrogen ions. A particularly difficult aspect of the problem is that the corrosion occurs above and in the temperature range of the initial condensation of water. The term "initial condensate" as used herein indicates a phase formed when the temperature of the surrounding environment reaches the dew point of water. At this point a mixture of liquid water, hydrocarbon, and vapor may be present. The initial condensate may occur within the distilling unit itself or in subsequent condensers and other equipment. The top temperature of the fractionating column is normally maintained above the dew point of water. The initial aqueous condensate formed contains a high percentage of HCl. The chlorine comes from salts in the crude, and recently the salt content of crude oil being used in refineries has increased, generating more chlorides. Due to the high concentration of acids dissolved in the water, the pH of the first condensate can be rather low. Thus, as noted, the condensed water can be highly corrosive. It is important that the first condensate is made less corrosive.

Conventionally, highly basic ammonia has been added at various points in the system in an attempt to inhibit the corrosiveness of condensed acidic materials. However, ammonia has not been effective to eliminate corrosion occurring at the initial condensate. In one non-limiting view, ammonia may be ineffective because it does not condense completely enough to neutralize the acidic components of the first condensate.

Amines such as morpholine and methoxypropylamine have been used successfully to control or inhibit corrosion that occurs at the point of initial condensation within or after the distillation unit. Adding amines to the petroleum fractionating system raises the pH of the initial condensate rendering the material substantially less corrosive. The amine inhibitor can be added to the system either in pure form or as an aqueous solution. In some cases, sufficient amounts of amine inhibitors are added to raise the pH of the liquid at the point of initial condensation to above 4.5; in some cases to between 5.5 and 6.0. Other highly basic (pKa>8) amines have been used, including ethylenediamine, monoethanolamine and hexamethylenediamine.

However, the use of these highly basic amines for treating the initial condensate has a problem relating to the resultant hydrochloride salts of these amines which tend to form deposits in distillation columns, column pumparounds, overhead lines, overhead heat exchangers and other parts of the system. These deposits occur after the particular amine has been used for a period of time, sometimes in as little as one or two days. These deposits can cause both fouling and corrosion problems and are particularly problematic in units that do not use a water wash.

Thus, it would be desirable if a method could be devised that neutralizes acid environments in distillation overheads of hydrocarbon processing facilities that minimizes or reduces deposits of hydrochloride and amine salts.

SUMMARY OF THE INVENTION

An object of the invention is to provide a method for neutralizing acid environments in distillation overheads of hydrocarbon processing facilities that minimizes or reduces deposits of hydrochloride and amine salts.

Other objects of the invention include providing a method for inhibiting corrosion of metal surfaces in a system in which hydrocarbons, water, ammonium chloride or amine hydrochlorides condense.

Another object of the invention is to provide a method for accomplishing the above goals using readily available amines.

In carrying out these and other objects of the invention, there is provided, in one form, a method for inhibiting corrosion of metal surfaces in a system that involves first providing a system in which hydrocarbons, water, ammonium chloride or amine hydrochlorides condense. An amine composition is added to the system in an amount effective to inhibit corrosion. The amine composition may be one sole amine that is tert-butylamine, ethyldimethylamine, or isopropyldimethylamine. The amine composition may also be at least two different amines that include dimethylethanolamine, n-butylamine, sec-butylamine, tert-butylamine, diethylamine, diethylethanolamine, dimethylamine, dimethylbutylamine, dimethylisopropanolamine, ethylamine, ethyldimethylamine, N-ethylmorpholine, isopropylamine, isopropyldimethylamine, methylamine, morpholine, n-propylamine, and/or trimethylamine.

In another non-limiting embodiment of the invention there is provided a method for inhibiting corrosion of metal surfaces in a system that involves providing a system for fractionating a mixture of hydrocarbons, water, ammonium chloride and amine hydrochlorides. The system has an upper zone which operates at temperatures below the water dew point of the mixture and a lower zone which operates at temperatures above the water dew point of the mixture. An amine composition is added to the system in an amount effective to inhibit corrosion. The amine composition may be one sole amine selected that is tert-butylamine, ethyldimethylamine, or isopropyldimethylamine. Alternatively, the amine composition may be at least two different amines including dimethylethanolamine, n-butylamine, sec-butylamine, tert-butylamine, diethylamine, diethylethanolamine, dimethylamine, dimethylbutylamine, dimethylisopropanolamine, ethylamine, ethyldimethylamine, N-ethylmorpholine, isopropylamine, isopropyldimethylamine, methylamine, morpholine, n-propylamine, or trimethylamine. The amine composition is added to the system at a rate sufficient to maintain the pH of water condensate in the system at a pH of about 4.0 or higher.

DETAILED DESCRIPTION OF THE INVENTION

Methods and compositions are disclosed for neutralizing acid environments in distillation overheads of hydrocarbon processing facilities. The neutralizers are composed of certain combinations of amines which are relatively stronger bases and more resistant to hydrochloride salt formation than currently used amine neutralizers. The amines, when blended together, provide greater neutralization of condensed water present without increased potential for corrosive hydrochloride salt formation.

For decades, refiners have struggled with providing adequate neutralization in overhead systems without forming corrosive salts. Ammonia and several amines have been tried to control corrosion with random successes and failures. The neutralizer amine blends of the invention will allow greater neutralization of corrosive acids in column overhead condensing systems without increasing the potential to form corrosive salts with hydrogen chloride.

The amines in the invention bind the hydrogen ions of equation (I) thus reducing their concentration. The amine composition of the invention may be added to the overhead system upstream of the aqueous dew point in one non-limiting embodiment of the invention. This addition point is usually the overhead line off of the distillation column or the vapor line off of a dry first condensing stage accumulator. While the amine blends of the invention were developed for systems without a water wash, it can also be used in conjunction with a water wash. Without a wash, the inventive amine composition should be injected neat into the center of the pipe via a quill or similar device. If a wash is present in the method, the inventive amine composition could be injected into the main wash line.

It will be appreciated that it is not necessary for corrosion in distillation overheads or other equipment to completely cease for the method of this invention to be considered successful. Indeed, the inventive method should be considered operative if corrosion is inhibited to a measurable extent. In the context of this invention, the term "corrosion inhibition" is defined to include any cessation, prevention, abatement, reduction, suppression, lowering, controlling or decreasing of corrosion, rusting, oxidative decay, etc. Similarly, the term "neutralize" refers to such corrosion inhibition by reducing the acidity of the chemicals or components in the system such as by raising pH, but does not require adjusting pH to be 7, but rather raising of pH and moving from acidity to basicity to some measurable extent. Furthermore, the nature of the metal surfaces protected in the methods of this invention is not critical. The metals in which the system operates may include, but are not necessarily limited to iron alloys, copper alloys, nickel alloys, titanium alloys, and these metals in unalloyed form as well, etc.

In one non-limiting embodiment amines suitable for use in the amine blends of the invention include, but are not necessarily limited to, dimethylethanolamine, n-butylamine, sec-butylamine, tert-butylamine, diethylamine, diethylethanolamine, dimethylamine, dimethylbutylamine, dimethylisopropanolamine, ethylamine, ethyldimethylamine, N-ethylmorpholine, isopropylamine, isopropyldimethylamine, methylamine, morpholine, n-propylamine, and trimethylamine. In another non-limiting embodiment of the invention, the amine blend may have two or more of these amines, and in yet another non-limiting embodiment of the invention the amine compositions are a blend of 3-5 of these amines. Alternatively, it is expected that amine compositions having only one sole amine that is either tert-butylamine, ethyldimethylamine or isopropyldimethylamine would be useful in the method herein as well.

In still another non-limiting embodiment of the invention, at least two of the amines in the amine composition are selected from the group consisting of dimethylethanolamine, sec-butylamine, and morpholine. Alternatively, the amine composition may include at least dimethylethanolamine and one or more of the amines listed above. Particularly, in another non-limiting embodiment the amine composition excludes the blend dimethylethanolamine with dimethylisopropanolamine. Particularly useful blends of amines in this invention include, but are not necessarily limited to, sec-butylamine, ethyldimethylamine, and morpholine together with either ethyldimethylamine and/or dimethylisopropanolamine.

In a particular non-limiting embodiment of the invention, the amines described may be blended using any weight ratio. The following weight ratios are particularly exemplary, but not necessarily limiting to the invention herein. The values given are ratios relative to another amine present in the composition at a ratio of 1, within the other requirements of the invention where two or more amines are used.

TABLE I

Approximate Weight Ratios of Some Suitable Amines

| Amine | Weight Ratio |
|---|---|
| n-Butylamine | 0.1-0.5 |
| sec-Butylamine | 0.5-2 |
| tert-Butylamine | 0.1-0.5 |
| Diethylamine | <0.1 |
| Diethylethanolamine | <0.1 |
| Dimethylamine | <0.1 |
| Dimethylbutylamine | 0.5-2 |
| Dimethylethanolamine | 0.5-2 |
| Dimethylisopropanolamine | 0.5-2 |
| Ethylamine | <0.1 |
| Ethyldimethylamine | 0.5-2 |
| N-Ethylmorpholine | 5-10 |
| Isobutylamine | 0.5-2 |
| Isopropylamine | 0.1-0.5 |
| Isopropyldimethylamine | 0.5-2 |
| Methylamine | <0.1 |
| Morpholine | 0.5-2 |
| n-Propylamine | 0.1-0.5 |
| Trimethylamine | 0.5-2 |

It will be appreciated that it is difficult to predict what the optimum dosage rate would be in advance for any particular system. The dosage will depend upon a variety of complex, interrelated factors including, but not necessarily limited to, the exact nature of the stream being fractionated, the temperature and pressure of the distillation conditions, the particular amine blends used, etc. In one non-limiting embodiment of the invention, the dosage rate will be determined on a case-by-case basis depending upon the acid content of the system. It may be desirable to use computer modeling to determine the optimum rate. Nevertheless, to provide some understanding of expected or possible dosage rates, the amount of amine composition may range from about 1 to about 10,000 ppm, based on the water mass. In another non-limiting embodiment, the amount of amine composition may range from about 10 to about 500 ppm.

The desired pH range for all points in the system is from about 4 to about 7.5, and in another non-limiting embodiment may be from about 5 to about 6.5. Alternatively, to give another idea of expected dosage rates, the amine composition may be added to the system at a rate sufficient to maintain the pH of water condensate in the system at a pH of about 4.0 or higher. In another non-limiting embodiment, the amine composition may be added to the system at a rate sufficient to maintain the pH at about 5.0 or higher.

Suitable solvents for the amine blends of this invention include, but are not necessarily limited to, water or hydrocarbon based fluids such as diesel, jet fuel, and the like. In one non-limiting embodiment of the invention, the system has a substantial absence of SO2. By "a substantial absence" is meant only trace amounts.

The amine blends of this invention will now be described with respect to specific Examples that are intended only to further illustrate the invention, but not limit it in any way.

Blend #1

| Amine | Weight Ratio |
|---|---|
| N-Ethylmorpholine | 27.2% |
| Dimethylethanolamine | 2.6% |
| Dimethylbutylamine | 9.4% |
| Isobutylamine | 0.8% |
| Water solvent | 60.0% |

Blend #2

| Amine | Weight Ratio |
|---|---|
| Isobutylamine | 18.8% |
| sec-Butylamine | 9.8% |
| n-Butylamine | 7.9% |
| n-Propylamine | 3.5% |
| Water solvent | 60.0% |

EXAMPLES 1-5

Simulation results for Blend #2 as compared with the components used individually in a particular overhead system are listed below in Table II

TABLE II

Performance in an Overhead System

| Ex. | Amine | Aqueous Dew Point pH | System - Salt Temperature, ° F. (° C.) |
|---|---|---|---|
| 1 | n-Propylamine | 3.35 | −10.3 (−5.7)(salts form) |
| 2 | n-Butylamine | 2.78 | −4.6 (−2.5)(salts form) |
| 3 | sec-Butylamine | 3.06 | −2.6 (−1.4)(salts form) |

TABLE II-continued

Performance in an Overhead System

| Ex. | Amine | Aqueous Dew Point pH | System - Salt Temperature, ° F. (° C.) |
|---|---|---|---|
| 4 | Isobutylamine | 3.14 | +4.7 (+2.6)(no salts form) |
| 5 | Blend #2 | 3.73 | +4.7 (+2.6)(no salts form) |

The Blend #2 results show significant improvement over the amines used independently. The aqueous dew point pH is improved by +0.6-0.9 while not creating conditions which will likely result in corrosive salt formation.

Many modifications may be made in the composition and method of this invention without departing from the spirit and scope thereof that are defined only in the appended claims. For example, the exact combination of amines and their proportions may be different from those used here. Additionally, the amine blends and methods of this invention may find utility in the processes different from those explicitly discussed. The use of other components in the amine blends of this invention not precisely identified may also fall within the inventive scope herein.

We claim:

1. A method for inhibiting corrosion of metal surfaces in an overhead system in which hydrocarbons, water, ammonium chloride or amine hydrochlorides condense, the method comprising adding to the overhead system an amine composition in an amount and at a rate sufficient to maintain the pH of water condensate in the system at a pH of about 4.0 or higher effective to inhibit corrosion, the amine composition comprising:

one sole amine selected from the group consisting of tert-butylamine, ethyldimethylamine, and isopropyldimethylamine; or at least two different amines selected from the group consisting of dimethylethanolamine, n-butylamine, sec-butylamine, tert-butylamine, diethylamine, dimethylbutylamine, dimethylisopropanolamine, ethylamine, ethyldimethylamine, N-ethylmorpho-line, isopropylamine, isopropyldimethylamine, methylamine, and trimethylamine.

2. The method of claim 1 where in the amine composition at least two different amines are used and at least two of the amines are selected from the group consisting of dimethylethanolamine and sec-butylamine.

3. The method of claim 1 where in the amine composition at least two different amines are used and at least one of the amines in the amine composition is dimethylethanolamine.

4. The method of claim 1 where the amine composition excludes the blend dimethylethanolamine with dimethylisopropanolamine as the only amines in the composition.

5. The method of claim 1 where in the amine composition at least four different amines are used including dimethylethanolamine and sec-butylamine, and where an additional amine is selected from the group consisting of ethyldimethylamine and dimethylisopropanolamine.

6. The method of claim 1 where, the amount of amine composition ranges from about 1 to about 10,000 ppm, based on the water mass.

7. A method for inhibiting corrosion of metal surfaces in an overhead system in which hydrocarbons, water, ammonium chloride or amine hydrochlorides condense, the method comprising:

adding to the overhead system an amine composition in an amount effective to inhibit corrosion and at a rate sufficient to maintain the pH of water condensate in the system at a pH of about 4.0 or higher, the amine composition comprising:

one sole amine selected from the group consisting of tert-butylamine, ethyldimethylamine, and isopropyldimethylamine; or at least two different amines selected from the group consisting of n-butylamine, sec-butylamine, tert-butylamine, diethylamine, dimethylbutylamine, dimethylisopropanolamine, ethylamine, ethyldimethylamine, N-ethylmorpho-line, isopropylamine, isopropyldimethylamine, methylamine, morpholine, and trimethylamine.

8. The method of claim 7 where in the amine composition at least two different amines are used and at least two of the amines are selected from the group consisting of sec-butylamine, and morpholine.

9. The method of claim 7 where in the amine composition at least four different amines are used including sec-butylamine, and morpholine, and where an additional amine is selected from the group consisting of ethyldimethylamine and dimethylisopropanolamine.

10. The method of claim 7 where, the amount of amine composition ranges from about 1 to about 10,000 ppm, based on the water mass.

11. A method for inhibiting corrosion of metal surfaces in a system for fractionating a mixture of hydrocarbons, water, ammonium chloride and amine hydrochlorides where the system has an upper zone which operates at temperatures below the water dew point of the mixture and a lower zone which operates at temperatures above the water dew point of the mixture, the method comprising:

adding to the system at or before the upper zone an amine composition in an amount effective to inhibit corrosion, the amine composition is selected from the group consisting of:

one sole amine selected from the group consisting of tert-butylamine, ethyldimethylamine, and isopropyldimethylamine; or at least two different amines selected from the group consisting of n-butylamine, sec-butylamine, tert-butylamine, diethylamine, dimethylbutylamine, dimethylisopropanolamine, ethylamine, ethyldimethylamine, N-ethylmorpho-line, isopropylamine, isopropyldimethylamine, methylamine, morpholine, and trimethylamine, where the amine composition is added at or before the upper zone of the system at a rate sufficient to maintain the pH of water condensate in the system at a pH of about 4.0 or higher.

12. The method of claim 11 where in the amine composition at least two different amines are used and at lest two of the amines are selected from the group consisting of sec-butylamine, and morpholine.

13. The method of claim 11 where in the amine composition at least four different amines are used including sec-butylamine, and morpholine, and where an additional amine is selected from the group consisting of ethyldimethylamine and dimethylisopropanolamine.

14. The method of claim 11 where, the amount of amine composition ranges from about 1 to about 10,000 ppm, based on the water mass.

* * * * *